US006427620B1

(12) United States Patent
Crawford

(10) Patent No.: US 6,427,620 B1
(45) Date of Patent: Aug. 6, 2002

(54) MULTIPURPOSE GARMENT

(75) Inventor: William C. Crawford, Baltimore, MD (US)

(73) Assignee: Xymid L.L.C., Petersburg, VA (US)

( * ) Notice: Subject to any disclaimer, the term of this patent is extended or adjusted under 35 U.S.C. 154(b) by 0 days.

(21) Appl. No.: 10/032,965

(22) Filed: Oct. 19, 2001

(51) Int. Cl.[7] ..... B63B 35/00
(52) U.S. Cl. ..... 114/347; 114/361
(58) Field of Search ..... 114/347, 364, 114/361

(56) References Cited

U.S. PATENT DOCUMENTS

| | | | | |
|---|---|---|---|---|
| 4,583,480 | A | 4/1986 | Hamilton et al. | 114/347 |
| 5,331,915 | A | 7/1994 | Snyder | 114/347 |
| 5,367,975 | A | 11/1994 | Hamilton et al. | 114/347 |
| 5,429,065 | A | 7/1995 | McShan | 114/347 |
| 5,511,507 | A | 4/1996 | Allen | 114/347 |
| 5,540,176 | A | 7/1996 | Galea | 114/361 |
| 5,579,715 | A | 12/1996 | Harrell | 114/361 |
| 5,894,811 | A | 4/1999 | Nordby | 114/347 |

OTHER PUBLICATIONS

Print of Eskimo in kayak with spear. Date unknown.
Photograph of Eskimo in kayak—www.fivetenpaddler.com advertisement. Date unknown.
Paddling.net Accessory Buyer's Guide computer printout from internet copyright 1999.
The Issues in Skirting, C. Ladner, WaveLength Paddling Magazine Nov., 1996.
NRS Paddlesports Equipment Guide 2001 pp. 78–79.
Zyflex® Thermal Sportsgear Fall 2000 catalog.

*Primary Examiner*—Ed Swinehart
(74) *Attorney, Agent, or Firm*—Jeffrey C. Lew

(57) ABSTRACT

A shirt is made of light weight, breathable and liquid moisture repellent fabrics. The shirt body includes at least one of two types of stretchable fabric. One type is mono-directionally elastic and the other is orthogonally bi-directionally elastic. The shirt includes one or more gusset panels positioned at or near the hem. The hem of the shirt can be stretched over the coaming of an open cockpit vessel, such as a kayak. Thus the shirt can serve as a combination dry top and spray skirt for a kayak paddler, especially in low to moderate turbulence water conditions. The shirt is comfortable, thin and sufficiently stylish to be worn in activities other than boating, including sporting and non-sporting activities.

21 Claims, 10 Drawing Sheets

MULTIPURPOSE GARMENT

FIELD OF THE INVENTION

This invention relates to a multipurpose garment useful as an article of sports equipment and also independently to be worn as a shirt during normal activity. More specifically, the invention pertains to a lightweight, weather resistant jersey of an elastic fabric capable of stretching fully to the coaming of an open cockpit boat, for example in the manner of a spray skirt for a kayak, to shield the wearer and the cockpit from spray, wind, rain, sun and the like.

BACKGROUND OF THE INVENTION

Water sports activities using kayaks has continued to develop in recent years with seemingly ever increasing popularity. Although made of modern materials, kayaks today bear close resemblance to the traditional Eskimo boat. They have a narrow beam, low freeboard and one or more cockpits each typically formed by an opening in the deck. The operator sits or kneels in the cockpit and powers the kayak manually with a double-ended paddle having a blade on each end.

Because of the kayak's excellent maneuverability and speed, many enthusiasts use them in fast moving, turbulent bodies of water under so-called whitewater conditions. Due to proximity to the water, the operator is often sprayed, splashed and occasionally capsized. To keep the operator and contents of the kayak dry, kayak manufacturers and sports outfitters have developed a selection of equipment intended to shield the body of the operator from spray and to prevent the cockpit from inundating with water caused by wave splashing or accidental roll over.

The earliest splash protection clothing utilized by the original Eskimo developers of the kayak and their descendants might have had a single piece parka design. Before synthetic waterproof clothing was developed, the parka body would be made of natural materials, perhaps such as animal skins which might be oil-coated to repel water. The parka would be expected to include a hood and long sleeves for protection against cold weather and water. The cockpit would likely be only slightly larger than the body of the kayak operator and the boat deck may have been built up high around the paddler. These features would reduce the risk of water from infiltrating between the body of the operator and the rim of the cockpit.

Use of kayaks has generally evolved from utilitarian purposes such as hunting and fishing for food to sport activities. Largely to accommodate a variety of cockpit opening shapes and kayak operator sizes, and to facilitate escape from a capsized kayak, two piece splash protection systems are now common. Such systems include a spray skirt and a dry top.

The spray skirt has a generally broad, flat portion typically designed to fit substantially flush to the kayak deck. The periphery of the flat portion is shaped to closely mate with the rim of the cockpit opening. A mechanism is usually provided to attach the edge of the spray skirt to the rim with a water tight seal. A quick release mechanism, often called a "grab loop" is also often included so that the user can detach the skirt to exit rapidly from the kayak hull when necessary. The two piece spray skirt has a hole approximately the size of the waist of the user and positioned at the location of the kayak operator's torso. Often the spray skirt has a tubular "chimney" ascending above or descending below the deck. Commonly the extension is fit snugly to the midsection of the operator's body.

The dry top part of the two piece system typically includes a water impenetrable cover for the upper body of the kayak operator. Many variations for arm and head openings are possible. For example, the sleeves may be long or short and the neck opening can terminate in a hood to keep the neck and hair dry. The waist of the dry top is normally adapted to connect to the circumference of the hole in the spray skirt with a water tight seal.

U.S. Pat. No. 4,583,480 describes a typical conventional spray skirt for a kayak.

U.S. Pat. No. 5,331,915 discloses a kayak cockpit cover primarily for a "squirt" kayak intended for use in whitewater. The cockpit cover has an upper body garment or dry top worn by the paddler as a waste closure. The dry top is constructed integrally with a planar covering section having an outside sealing edge assembly that inserts into a complementary tubular channel formed in the deck surrounding the cockpit. The edge of the cockpit cover is sealed to the deck by inflating the edge assembly within the channel. The cover is bulky and would not be worn as a garment independent of its function while operating a kayak.

A growing commercially significant group of kayak users enjoy kayaking in less than rough water conditions. These "casual" kayak enthusiasts prefer calm waters of lakes, slow moving streams, broad rivers and the like. Because kayaks are generally light weight, small and have shallow drafts, they are favored by casual users for activities such as camping and exploring remote wilderness areas.

Casual kayak users also have need to keep themselves and the cockpit dry and otherwise shielded from the environment. However, the casual user is not as likely as the whitewater kayaker to become drenched or capsized by turbulent water flow. In contrast, the casual user probably risks exposure to rain, snow or spray from an errant paddle stroke. Casual kayakers are also concerned with exposure to sun, wind and insects. Moreover, casual kayakers frequently paddle in still water and therefore are required to expend considerable energy while paddling. This activity can generate much body heat and perspiration in the process. An absolute moisture barrier used by many whitewater kayakers can trap heat and moisture inside the boat and could become hot and uncomfortable for the casual kayak user.

Conventional spray skirt and dry top are also typically bulky. They are difficult to stow in small spaces when not needed. They are also heavy and occupy a large volume when being transported. Traditional spray skirt and dry top systems have an ungainly appearance when worn outside of the boat. The dry tops usually are made from thick foam or rubber material and give the impression of a diver's wet suit or a rain slicker. Sometimes the user detaches the spray skirt from the cockpit and keeps the dry top connected to the hole of the spray skirt. In that case, the flat portion of the spray skirt either extends parallel to the ground ahead and behind the wearer or droops down, perhaps touching the ground. Casual kayak users sometimes carry a kayak overland to a remotely accessible waterway or around an obstacle such as shallows or rapids. Portaging along wooded forest trails while wearing conventional dry top and spray skirt equipment can be awkward at best and dangerous at worst.

In sum, conventional dry top and spray skirt systems for kayaks have been designed primarily for rough and usually cold water boating. For casual kayak uses these system designs suffer from numerous drawbacks such as:

(a) They are heavy.

(b) They are bulky and take up excessive space when stowed away.

(c) They can have shoulder straps to keep flimsy fabric skirt chimneys high. The straps are confining, get in the way of changing layers of garments worn underneath dry top, and interfere with the personal flotation device worn by the boater.

(d) They can have drawcords at waist to keep the chimneys high. These cords are tight, uncomfortable, tend to slide down and can allow water to enter the cockpit when the cord is not very snug against the body.

(e) They can have elastic chimneys which require proper fit around the body and must adjust to even slight body size variation produced by thickness of undergarments. Hence, adjustment straps or multiple chimney tubes for different configurations must be used.

(f) The skirts should be specially fit to kayak cockpit shape. Different skirts are needed for different kayaks.

(g) Dry tops attached to skirts seal water better but hinder escape from capsized boat.

(h) Dry tops separate from skirts are easier to exit but are less dry.

(i) Rubber and rubber-coated nylon skirts and tops have poor breathability. They can be hot and stuffy, and feel uncomfortable against skin.

(j) They are difficult and time consuming to don and to adjust for proper fit.

(k) They are expensive (l) They have limited stretching capability which restricts body movement of the paddler.

It is desirable to have a general purpose or light duty spray shield for casual kayak use. The desired spray shield would be light, comfortable to wear against the skin, breathable for a comfortable climate inside the boat, and yet have high insulation-to-weight characteristics. It is needed to have a spray shield that is easy to don, easy to mount to the cockpit coaming, adapted to fit different size boat cockpits, and compact for efficient storage. It is also desirable to have a sufficiently stylish garment that can be worn as an article of clothing when not being used as a kayak spray shield.

SUMMARY OF THE INVENTION

The present invention thus provides a multipurpose garment suitable to be worn by a person in a cockpit of a transportation vessel having a coaming surrounding the person, the multipurpose garment comprising (a) a shirt body adapted to cover at least the torso of the person, and consisting essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, which garment is adapted to stretch elastically such that the hem circumferentially overlaps the coaming to form a complete removable cover over the cockpit between the trunk of the person and the coaming.

There is also provided an environmental barrier system for a boat comprising, a boat comprising a cockpit to be occupied by the person surrounded by a coaming, a multipurpose garment comprising (a) a shirt body adapted to cover at least the torso of the person, and consisting essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, which garment is adapted to stretch elastically such that the hem circumferentially overlaps the coaming to form a complete removable cover over the cockpit between the trunk of the person and the coaming and fastening means for removably attaching the hem coextensively to the coaming to form a spray-proof seal between the hem and the coaming.

Still further this invention provides a method of protecting a person from spray in a cockpit of a boat having a coaming surrounding the cockpit comprising the steps of (I) providing a multipurpose garment comprising (a) a spray resistant shirt body adapted to cover at least the torso of the person, and consisting essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, (II) placing the spray resistant shirt on the person, and (III) with the person occupying the cockpit, stretching the hem coextensively over the coaming so that the garment covers the cockpit, thereby shielding the person and the cockpit between the person and the coaming from spray.

DETAILED DESCRIPTION

Figure 1A:
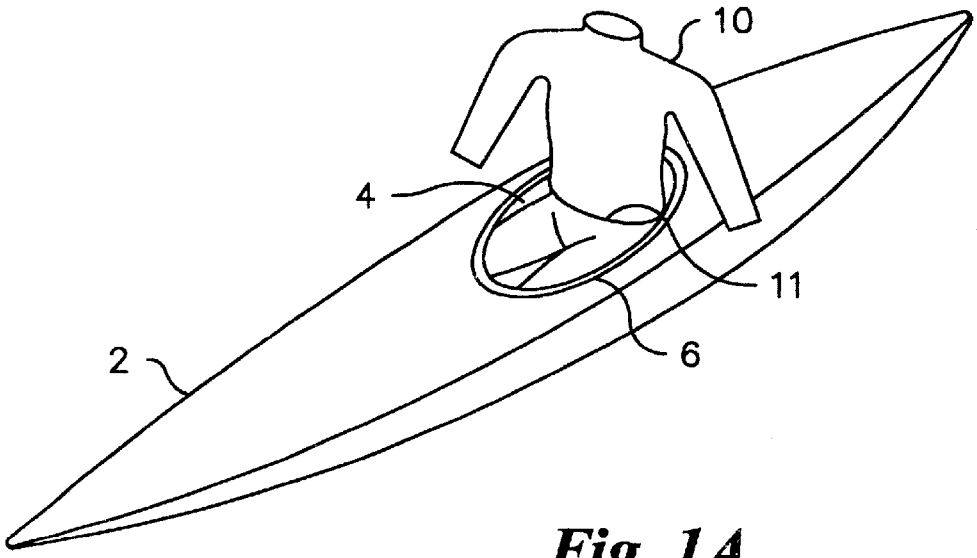
FIG. 1A is a perspective view showing a shirt according to an embodiment of this invention being worn by an operator of a kayak prior to deploying the shirt as a spray skirt.

The novel garment fulfills the need for a lightweight, comfortable and effective spray shield for casual kayak use. The garment is a shirt of a porous fabric formed from water resistant materials. By "water resistant" is meant that the material is at least moderately hydrophobic and repels water. That is, droplets of liquid water are not absorbed into the material. Also, the construction of the fabric has a small pore size effective to reject droplets of liquid water. Thus, the shirt provides a good barrier to water drops in air. The term "drops" is intended to encompass a range of particles from mist and fog moisture to rain drop size. The shirt also provides good protection against light spray and foam from waves and paddle splashes. Furthermore the barrier is effective to prevent water dripping from kayak paddle blades toward the central grip of the paddle from penetrating the garment and wetting the lap of the paddler.

By virtue of the structure of the fabric, the garment is porous. Although the porosity and fiber composition reject liquid water droplets as mentioned, the porosity permits free passage through the fabric of water in vapor form. This feature, sometimes referred to as "breathability" provides ventilation for reducing humidity inside the cockpit and hull from perspiration and other liquid water that might accumulate in the boat. Consequently, the shirt facilitates the natural cooling effect of evaporation of body moisture generated by the paddler and makes the activity of paddling feel less arduous and more pleasant.

In view of the porosity of the fabric, it should be understood that the garment does not purport to provide waterproof performance that is sought and achieved by many rubber and rubber coated materials used in conventional spray skirts. The novel garment when deployed properly by the operator of a kayak does attach to the cockpit coaming, as will be more fully explained, below, to provide a seal against spray. However, the recommended mechanisms for sealing the shirt to the coaming are perhaps less robust than means utilized by conventional whitewater spray skirts. For this reason, the seal of this garment to the coaming might remain intact after a quick 360 degree roll, but it probably will give way under pounding of heavy surf, waves or prolonged partial or full capsize conditions. Hence it is emphasized that the novel garment is directed mainly to casual kayak use in calm waters and moderate environmental conditions in which the risk of submerging the deck of the craft or slamming into waves is diminished.

The novel garment is also ideal for casual kayak use because it is light weight and thin. The weight and thickness of fabric of the shirt are comparable to those of normal clothing. Accordingly, the garment is comfortable to wear and it does not interfere with a personal flotation device or other clothing worn by the paddler. The weight of the fabric which constitutes nearly all of the novel garment is preferably about 3–25 oz/yd$^2$ (about 100–850 g/m$^2$), more preferably about 4–20 oz/yd$^2$ (about 135–680 g/m$^2$), and most preferably about 5–18 oz/yd$^2$ (about 170–610 g/m$^2$). A typical kayaker's shirt according to this invention contains about 2 m$^2$ of fabric about 75% of which constitutes type I fabric and the balance type II fabric. Such a shirt normally weighs less than about 700 g and typically about 590 g. In contrast, the weight of a traditional neoprene rubber or neoprene rubber-coated nylon spray skirt and dry top is about 765 g. The user can don a life jacket directly over the shirt. Moreover, a basic embodiment of the garment is a jersey form of shirt that is donned by pulling over the head of the wearer. Adjustment mechanisms and suspender straps are not required. Thus the garment is simple, easy and quick to put on.

An additional beneficial feature of the garment is that it is sufficiently lightweight, thin, form-fitting and stylish to be worn as a shirt in activities other than operating a kayak. Indeed, it is contemplated that the user will find value in wearing the multipurpose garment prior to boarding the kayak in which case the shirt will be instantly ready for deployment as a spray shield without extensive preparatory adjustments. Because the shirt performs the function of a traditional spray skirt, it eliminates the need for the kayak operator to carry one extra piece of relatively heavy and definitely bulky equipment. The light and thin fabric of the novel shirt permits it to be folded compactly for storage. The shirt needs only a small amount of stowage space.

Preferred materials that are able to provide the appropriate combination of hydrophobicity, breathability and density are olefin polymers, copolymers and mixtures of them. Representative olefin polymers include various grades of polyethylene and polypropylene.

The novel multipurpose garment comprises at least one of two types of elastic fabric, Except for certain accessory features, such as fasteners, for example, zippers, buttons, snaps, hook-and-loop and the like, decorative or informative labels and patches, and other items such as draw cords, the novel garment consists essentially of such elastic fabric.

The fabric may be characterized by a system of two mutually orthogonal, first and second dimensions in the plane of the fabric. Usually the first dimension corresponds to the machine direction or "MD", i.e., the direction in which the fabric travels continuously through the manufacturing machine, and the second dimension corresponds to the cross direction or "XD", i.e., perpendicular to the MD. These first dimension and second dimensions are sometimes referred to herein as the "longitudinal" and the "transverse" dimensions, respectively.

One of the elastic fabric types (occasionally hereinafter referred to as "type I fabric") is mono-directionally elastic. That is, type I fabric can be stretched at ambient temperature in the longitudinal dimension to a specified incremental percentage of its original, relaxed state length and it will return to its substantially original length upon release of the tension. Preferably the elasticity in the longitudinal dimension is at least about 30%, more preferably at least about 50%, and most preferably at least about 100%. The type I fabric is substantially non-elastic in the transverse dimension. More specifically, the elasticity in the transverse dimension is preferably less than about 5%.

The second elastic fabric type ("type II fabric") is bi-directionally elastic. That is, type II fabric according to this invention is at least about 30%, more preferably at least about 50%, and most preferably at least about 100% elastic in both the first and second dimensions.

The elastic, moisture barrier and vapor transmission properties of the fabric are derived from the combination of the composition of the materials of construction and the structure of fabric. For example, the desired elasticity can be provided by use of various elastic fiber materials. One such preferred material is Lycra® spandex polyurethane elastomeric fiber.

A preferred type I fabric that is suitable for use in the novel shirt of this invention is made from a spunbonded fibrous nonwoven sheet of substantially nonbonded, flash spun polyethylene plexifilaments by stitchbonding the sheet with two types of thread. More specifically, the sheet preferably comprises Tyvek® spunbond polyolefin (E. I. du Pont de Nemours & Co.) of about 1.2 oz/yd$^2$ (40.8 g/m$^2$) weight. This sheet is stitchbonded on a two-needle bar, stitchbonding machine in which both bars have 14 needles per inch (5.5/cm), the needles are fully threaded and are set to insert 14 courses per inch (5.5/cm). The back bar thread is an elastic yarn of 70 denier (78 dtex) Lycra® spandex (E. I. du Pont de Nemours & Co.) wrapped with 40 denier (44 dtex) 13 filament nylon yarn which is inserted in a pattern of 0–1, 1–0 chain stitches. The front bar thread is a 70 denier (78 dtex) 34 filament textured nylon yarn which is inserted in a pattern of 1–2, 1–0 tricot stitches. The stitching threads are inserted while maintaining the sheet under sufficient tension to assure formation after subsequent heat treatment of desired contraction and bulkiness of the final product. After stitchbonding, the fabric is heated free of tension in near boiling water (90–100° C.) and allowed to contract in length and width. Typically, a heat treatment of 2 to 3 minutes is sufficient to achieve contraction to about 50% of the original length and about 5% of the original width. The heat treated and contracted fabric weighs about 5.5 oz/yd$^2$ (187 g/m$^2$).

A preferred type II fabric that is suitable for use in the novel shirt of this invention is made using one spunbonded fibrous nonwoven sheet of substantially nonbonded, flash spun polyethylene plexifilaments and one powder bonded fibrous nonwoven sheet of staple polyester which are simultaneously stitchbonded together with two types of thread. More specifically, the spunbonded sheet preferably comprises Tyvek® spunbond polyolefin of about 1.2 oz/yd$^2$ (40.8 g/m$^2$) weight. The powder bonded sheet comprises staple polyester fibers thermally bonded together using a low melt polyester adhesive. This sheet has a total weight of about 1.2 oz/yd$^2$ (40.8 g/m$^2$). Both sheets are stitchbonded together on a two-needle bar, stitchbonding machine in which both bars have 14 needles per inch (5.5/cm), the needles are fully threaded and are set to insert 7 courses per inch (2.8/cm). The back bar thread is an elastic yarn of 70 denier (78 dtex) Lycra® spandex wrapped with 40 denier (44 dtex) 13 filament nylon yarn which is inserted in a pattern using a 1–0, 4–5 notation. The front bar thread is a 70 denier (78 dtex) 34 filament textured polyester yarn which is inserted in a pattern using a 2–3, 1–0 notation. The stitching threads are inserted while maintaining each sheet under sufficient tension to assure formation after subsequent heat treatment of desired contraction and bulkiness of the final product. After stitchbonding, the fabric is heated free of tension in near boiling water (90–100° C.) and allowed to contract in length and width. Typically, a heat treatment of 30 to 40 minutes is sufficient to achieve contraction to about 50% of the original length and about 45% of the original width. The heat-treated and contracted fabric weighs about 17 oz/yd$^2$ (576 g/m$^2$). (Conventional warp knitting nomenclature is used to describe the repeating stitch patterns that are employed in preparing the fabrics.) The type I and type II fabrics described above can be obtained under the tradename Zyflex® from Xymid LLC, Petersburg, Va.

The aspects of the present invention can be further understood with reference to the drawings. FIG. 1A shows a shirt 10 embodying the invention as would be worn by an operator sitting in a cockpit 4 of a kayak 2. The circumference of the cockpit is defined by a profile form 6 occasionally referred to as a coaming. Prior to deployment of the shirt as a spray skirt, the shirt is seen to fit closely to the body of the wearer. That is the shirt fabric contacts the surface of trunk (chest area, back and sides) of the wearer. The edge 11 of the shirt hem lies close to the wearer's waist near the belt line. It is contemplated that the multipurpose garment can be worn in this fashion in activities other than operating a kayak.

Figure 1B:
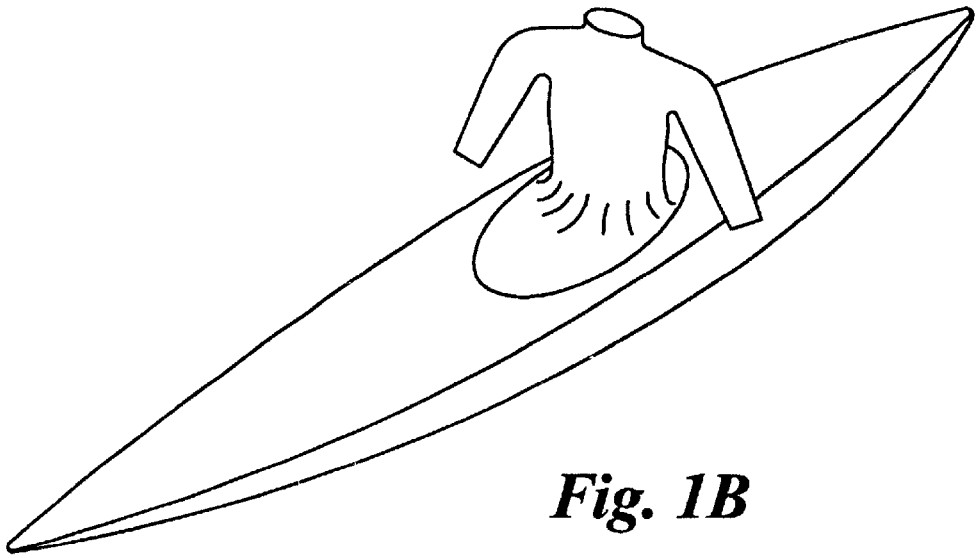
FIG. 1B is a perspective view showing the shirt of FIG. 1A being deployed as a spray skirt by having the hem stretched over the coaming of the kayak cockpit.

FIG. 1B illustrates the novel garment of FIG. 1A after deployment for protection against infiltration into the cockpit of spray, wind, sun and the like. The spray skirt feature is enabled by the wearer grasping the edge 11 (FIG. 1A) and stretching the hem outward so that the edge wraps over the profile form of the full coaming to completely cover the cockpit opening. In a basic embodiment, the hem of the shirt is reinforced with additional fabric thickness or multiple layers of fabric. Because the hem is stretched circumferentially, elastic recovery force causes the hem to contract about the profile form of the coaming and thus to retain the hem stretched over the cockpit.

Figure 2:
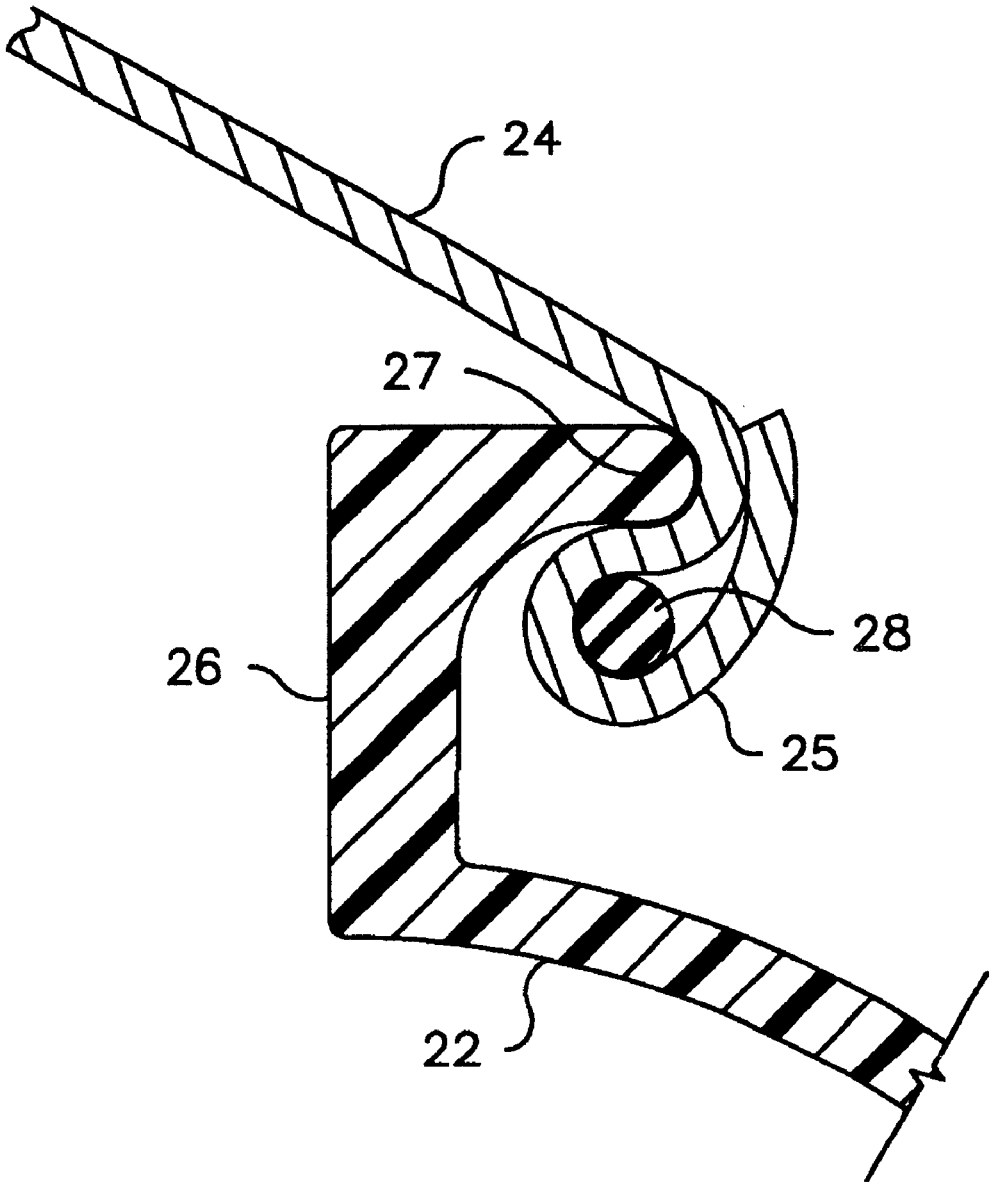
FIG. 2 is a section view of a hem of a shirt according to another embodiment of this invention seen stretched over a coaming of a kayak cockpit

In another embodiment (FIG. 2), the kayak hull 22 is seen to have a profile form 26 that defines an outboard facing overhang 27. The hem 24 of the novel garment optionally includes at its edge a channel fabricated by looping the hem fabric 25 onto itself and securing the looped back portion with conventional means such as anchor stitches or adhesive, not shown. A draw cord or elastic band 28 is threaded through the channel of the hem and is cinched against the overhang 27 of the coaming profile form to strengthen the attachment between the garment and the cockpit coaming. Preferably the attachment between the garment and the coaming should be removable for quick disengagement to allow the kayak operator to escape from the hull in the event of capsize or similar reason. Other methods of bolstering the removable attachment between the garment and the coaming are contemplated. For example, the mating surfaces of the coaming and the hem can be equipped with complementary elements of a hook and loop fastening system as is well known in the fastening arts.

Figure 10B:
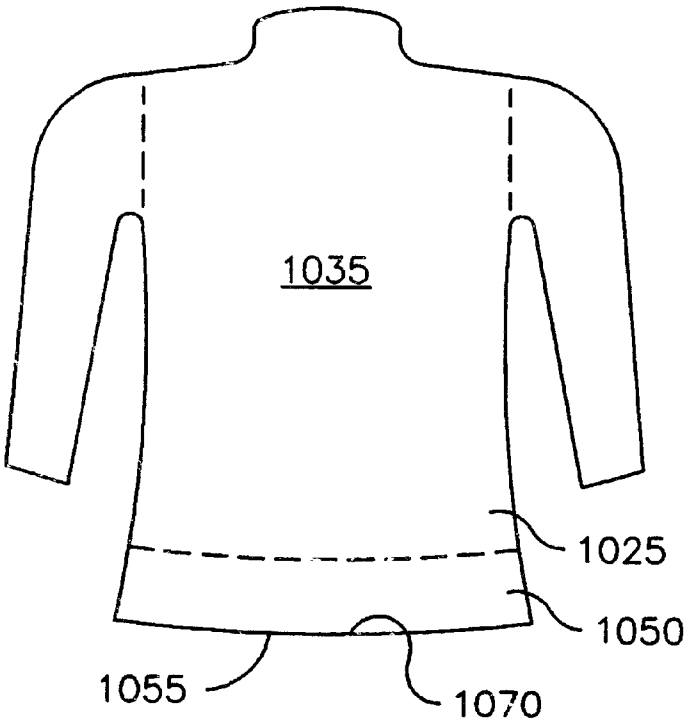
FIG. 10B is a rear elevation view of a diagram illustrating various parts of a multipurpose garment.
Figure 10A:
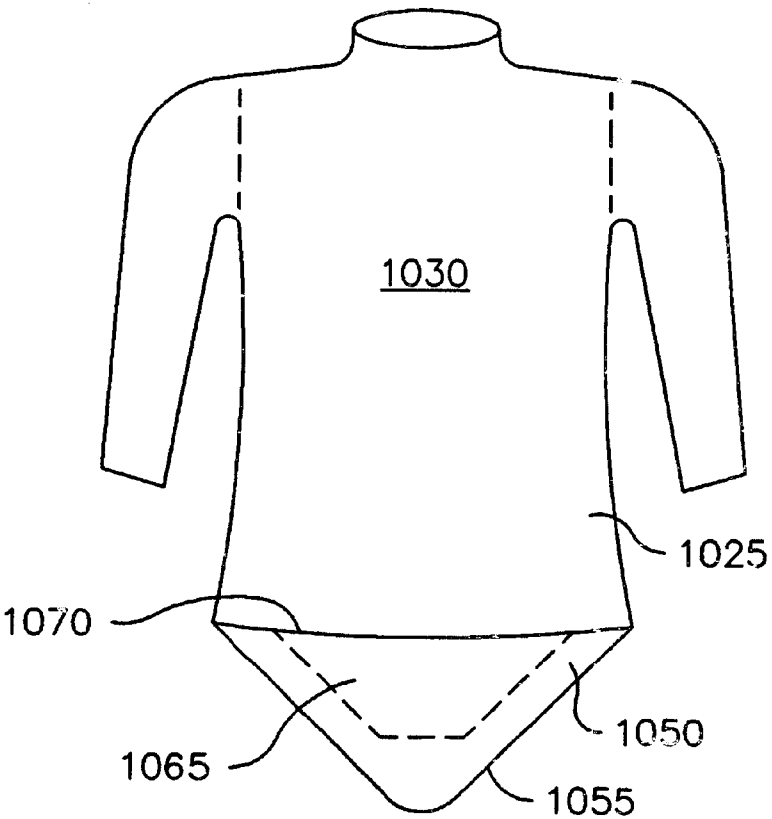
FIG. 10A is a front elevation view of a diagram illustrating various parts of a multipurpose garment.

As used in this application, the following terms concerning garment structure refer to the correspondingly defined meanings. The definitions are further understood with reference to FIGS. 10A and 10B. "Shirt body" 1025 means the portion of the garment that covers the chest 1030 and back 1035 of the upper body. "Hem line" 1055 means the bottom perimeter of the garment. "Hem" 1050 means the portion of the shirt body adjacent to the hem line. "Shirt-tail" 1065 means an extension of the shirt body descending from a horizontal reference line 1070 near and typically slightly below the waist line of the body.

A preferred embodiment of the novel multipurpose garment can be explained with reference to FIGS. 3A and 3B. The basic form of the shirt is a jersey 300 (FIGS. 3A and 3B) which has no front opening but is intended to be donned by pulling over the head. The shirt has many conventional features such as sleeves, (long sleeves 305 illustrated) and neck hole at the top 315. Other embodiments include optional features such as pockets, short sleeves and integral or removable hood. The illustrated embodiment includes in the shirt body 325 a slit 330 with optional re-sealable closure (not shown). The slit provides direct access through the garment to the space under the shirt when the shirt is deployed as a spray skirt without the need to release the hem from the cockpit coaming. The re-sealable closure mechanism can be any of the well known types for such purpose, such as mating hook and loop fastener elements, a zipper, buttons, and an overlapping flap with a snap fastener. Although a single slit is shown, more than one can be included in a shirt. The shirt is further defined by a hemline 350 which extends along the circumference of the bottom of the shirt in the usual manner.

The following conventions have been adopted in reference to features of the shirt. The direction from neck 315 to hem line 350 is referred to as the "length" or "lengthwise direction" with respect to the shirt body 325 of the garment. As appropriate, this direction is indicated in the figures by an arrow identified by the symbol "L". The cross chest, or shoulder-to-shoulder direction which is normal to the lengthwise direction and substantially parallel to the hem line 350, is sometimes referred to as the "width" or "widthwise direction". An arrow referenced by the symbol "W" is used to identify the widthwise direction.

Figure 3B:
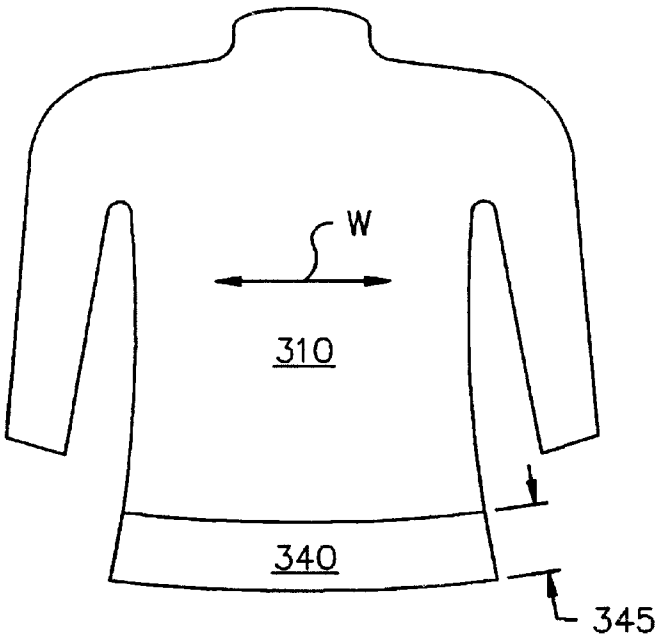
FIG. 3B is a rear elevation view of the shirt shown in FIG. 3A.
Figure 3A:
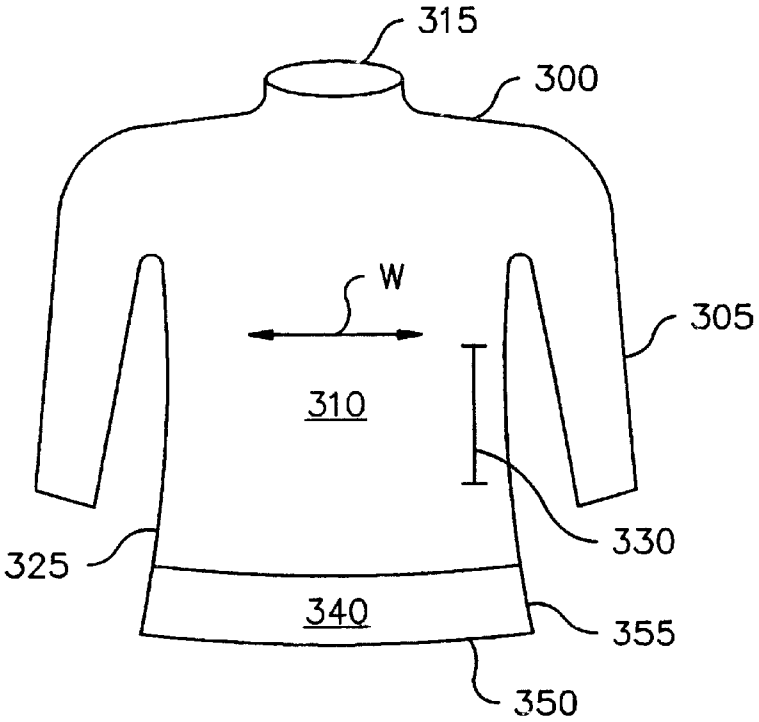
FIG. 3A is a front elevation view of a shirt according to an embodiment of this invention.

In a basic embodiment of the novel multipurpose garment shown in FIGS. 3A and 3B the front and rear of the shirt body 325 are made of type I fabric 310. The longitudinal dimension of this fabric is aligned widthwise, and therefore, the body of the shirt is elastic in the widthwise direction indicated by arrow W. The shirt body is substantially non-elastic in the lengthwise direction. The hem 355 is the border section located adjacent the hemline 350. In the illustrated embodiment, the hem extends fully around the front and back of the garment. It has a substantially uniform height 345. The hem of this embodiment is fabricated of type II fabric, and thus, it is elastic in two directions. In the embodiments of this invention described below, when a bi-directionally elastic type II fabric is employed, the alignment of the first and second dimensions with the width, length or any other feature of the garment is not critical. However, preferably, one of the first or second dimensions should be aligned lengthwise and the other of the two orthogonal dimensions should be aligned widthwise with respect to the garment.

The kayak operator deploys the multipurpose garment as a spray skirt after donning the garment and sitting in the cockpit. The operator grabs the shirt at the hemline and stretches it away from the body to and over the coaming of the kayak. The lower portion of the shirt body forms a taught canopy between the coaming and the upper body of the wearer. The canopy shields the contents of the kayak, including the operator, from various environmental exposures. The hem of the shirt is held in place on the coaming by any of the mechanisms already mentioned.

Figure 4B:
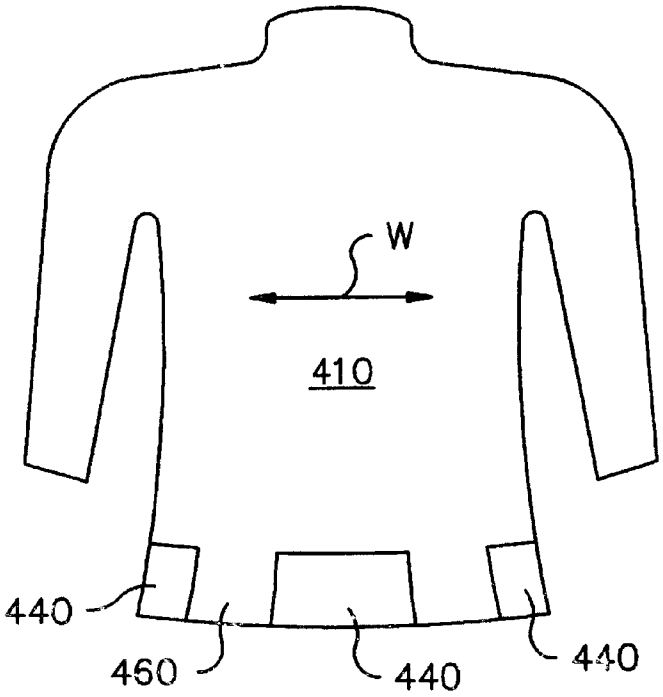
FIG. 4B is a rear elevation view of the shirt shown in FIG. 4A.
Figure 4A:
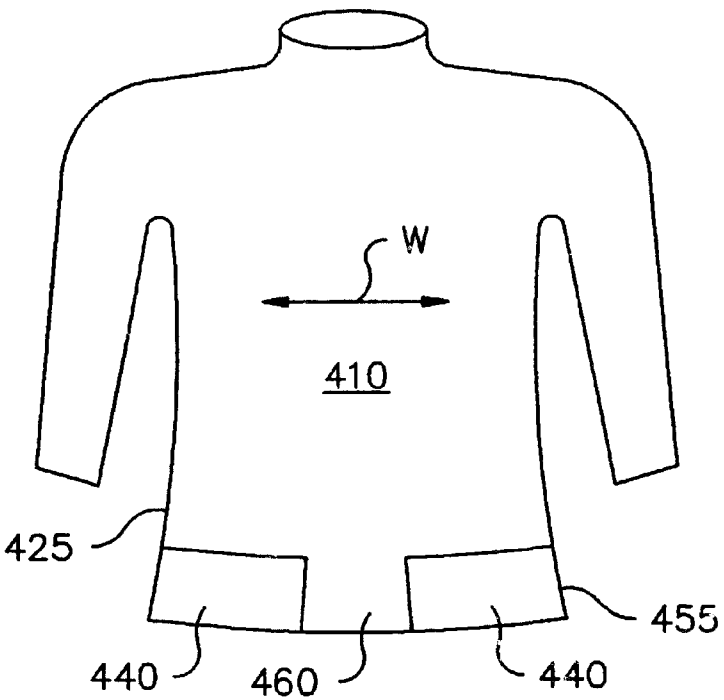
FIG. 4A is a front elevation view of a shirt according to an embodiment of this invention.

Certain preferred embodiments in addition to those already described of the multipurpose garment according to this invention have been found to advantageously provide ease of deploying and strong gripping to the coaming of kayaks having different cockpit shapes. These additional embodiments can be understood with reference to FIGS. 4A, 4B–9A, 9B. In each of these figures, the drawing labeled "B" shows the back of the correspondingly numbered drawing labeled "A". For example, FIG. 4A shows a front view and FIG. 4B shows a rear view of a multipurpose garment in which the shirt body 425 is constructed of type I fabric 410. This fabric is oriented so that the elastic direction is aligned widthwise as seen by the arrow W. This garment is a variation of that shown in FIGS. 3A,3B in that the hem comprises portions 455 of type II fabric 440 disposed circumferentially along the hem line. These portions have a substantially uniform height. In this embodiment, type I fabric 410 of the shirt body 425 extends fully to the hem line in portions 460 positioned between portions 455 of type II fabric.

Figure 5B:
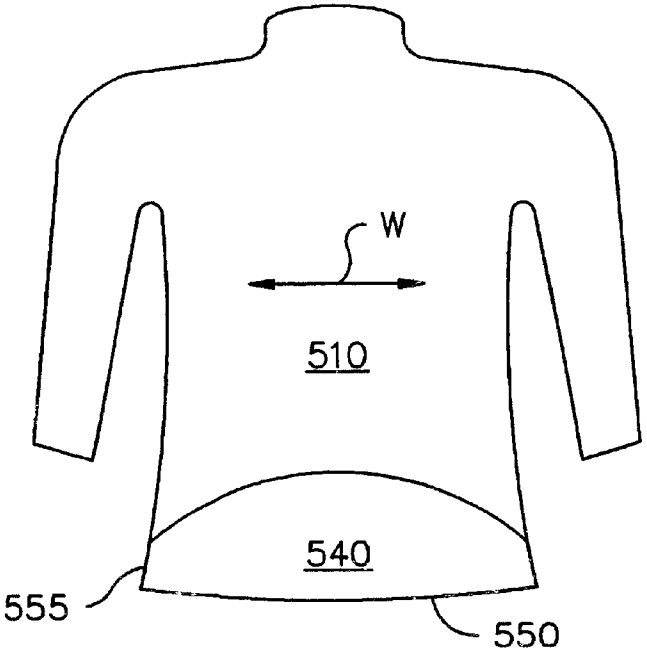
FIG. 5B is a rear elevation view of the shirt shown in FIG. 5A.
Figure 5A:
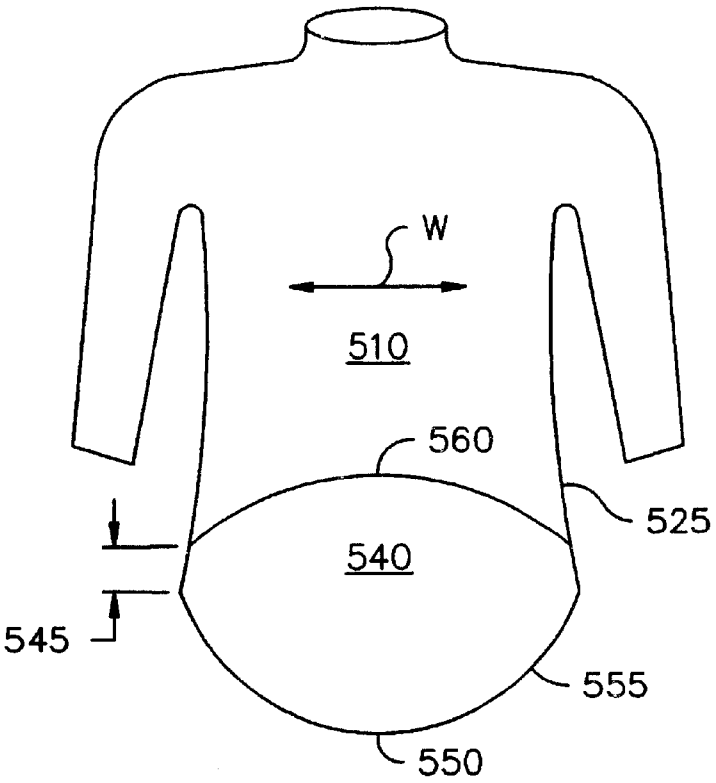
FIG. 5A is a front elevation view of a shirt according to an embodiment of this invention.

In another preferred embodiment shown in FIGS. 5A and 5B, the shirt body 525 is also constructed of type I fabric 510 having its direction of elasticity aligned widthwise. The hem 555 is formed from bidirectionally elastic type II fabric 540. The hem differs from previously described embodiments in that its height dimension 545 varies along the circumference of the hem line 550. More specifically, in the front view (FIG. 5A), the hem has a reduced height dimension at each side of the garment and the height dimension increases to a maximum at the center, i.e., the maximum occurs at, above or below the navel on the body. In this embodiment, the hem line descends in front to form an elongated shirt-tail. This allows the front of the shirt to better conform to certain kayak cockpit coamings in which the cockpit includes an elongated extension forward of the kayak operator. The hem on the back of this shirt also is made of type II fabric 540 and has a variable height. However, the hem line of the back does not descend to form a shirt-tail. This design would be suited for a cockpit that closely conforms to the back of the body of the operator.

The shapes of the shirt tail and upper boundary 560 of the hem are not critical. They can be modified to fit a particular style of kayak cockpit. For example, the hem line 550 of the shirt in FIG. 5B could be changed to form a shirt-tail to suit a kayak having an oval cockpit or a cockpit with an elongated extension aft of the operator. Because due the type II fabric used in the hem of the novel garment is highly elastic in the lengthwise direction, it is normally unnecessary to make the height shirt-tail very large. The hem of the garment will readily stretch over many cockpit shapes. In the event that a very long shirt-tail is needed to conform to a very elongated cockpit, the garment can be equipped with a fastener system adapted to secure the end of the tail to the shirt body. Thus the novel garment can be worn in an aesthetically pleasing fashion without the tail drooping far below the waistline. For example, one part of a hook and loop fasting system can be placed on the tip or near the hem line of the tail. The mating part of the hook and loop fastening system can be attached to the inside of the garment and the tail can be folded upward and hidden inside the garment when not deployed. Other fastener types may be used, such as buttons and snaps.

Figure 6B:
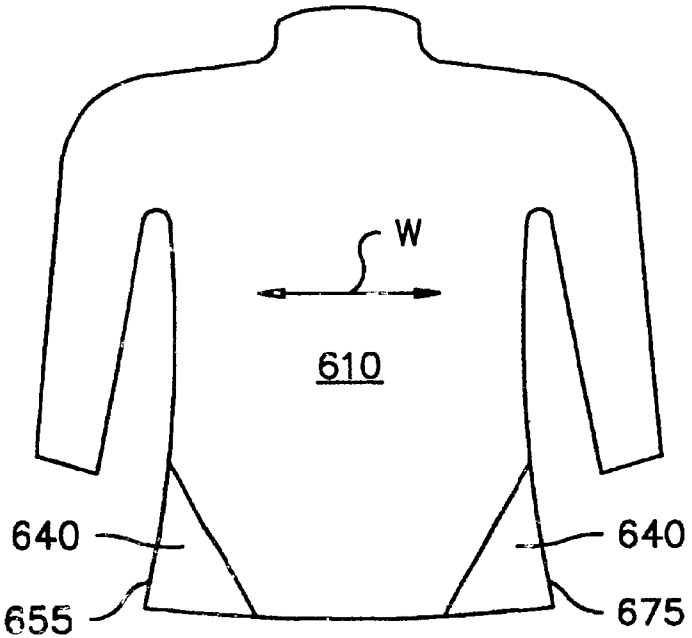
FIG. 6B is a rear elevation view of the shirt shown in FIG. 6A.
Figure 6A:
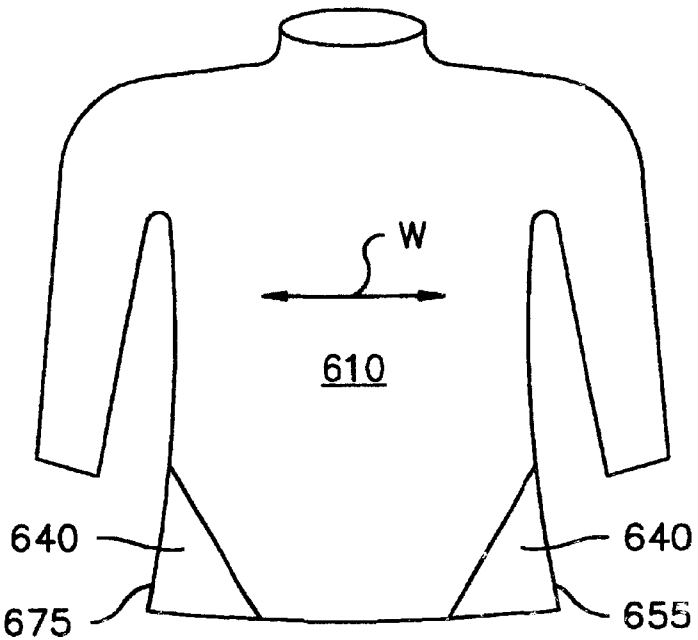
FIG. 6A is a front elevation view of a shirt according to an embodiment of this invention.

Yet another preferred embodiment is illustrated in FIGS. 6A and 6B. The shirt body of the garment is formed of type I fabric oriented so as to align the direction of elasticity widthwise as seen by arrow W. This embodiment includes two triangular gussets, 655 and 675, of type II fabric. The gussets are positioned on each side of the shirt body. In the illustration, a portion of each gusset can be seen from the front and from the rear. This garment style provides increased stretching capability of the garment hem to accommodate larger cockpits without significantly detracting from the form-fitting nature of the shirt when not deployed on a cockpit coaming.

Placement and number of the gussets is not critical. The gusset also can have a variety of shapes, such as triangular, as shown, parallelogram, rectangular and oval. In the illustrated embodiment, the triangular gusset has one side on the hem line. In another contemplated embodiment, a parallelogram gusset with an apex positioned on the hem line is used. In still another embodiment, a rectangular gusset with one side positioned on the hem line can be used. Other gusset configurations are contemplated to provide stylish, non-restraining fit to the wearer off the boat and while paddling and also to facilitate stretching the trunk and hem over the coaming of the kayak when deploying the spray skirt feature. For example, in variations of the embodiment shown in FIGS. 6A and 6B, the triangular gussets can be placed wholly on the front and/or wholly on the rear of the shirt.

Figure 7B:
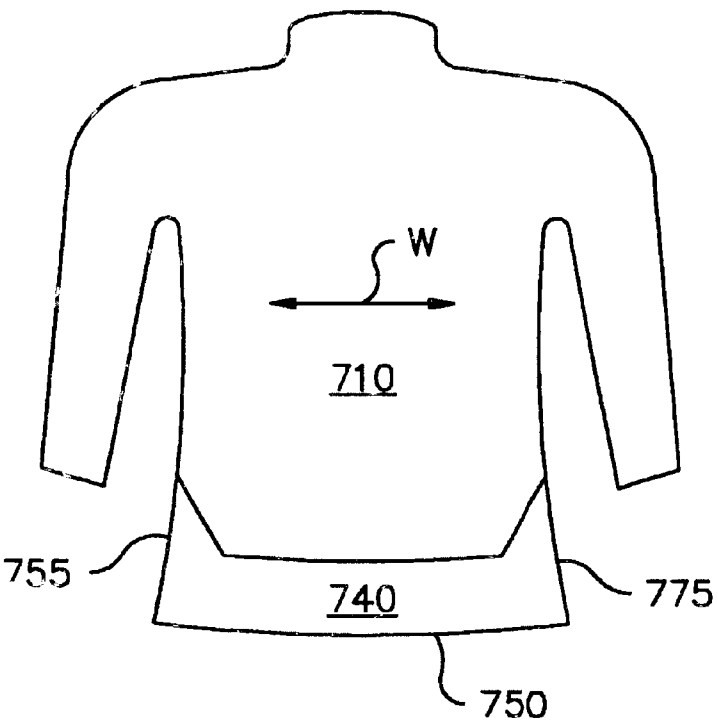
FIG. 7B is a rear elevation view of the shirt shown in FIG. 7A.
Figure 7A:
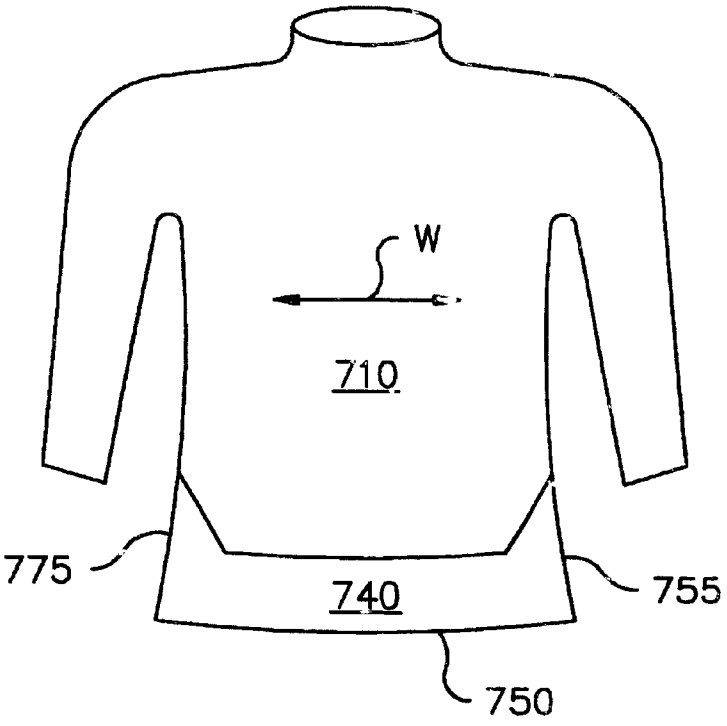
FIG. 7A is a front elevation view of a shirt according to an embodiment of this invention.
Figure 8B:
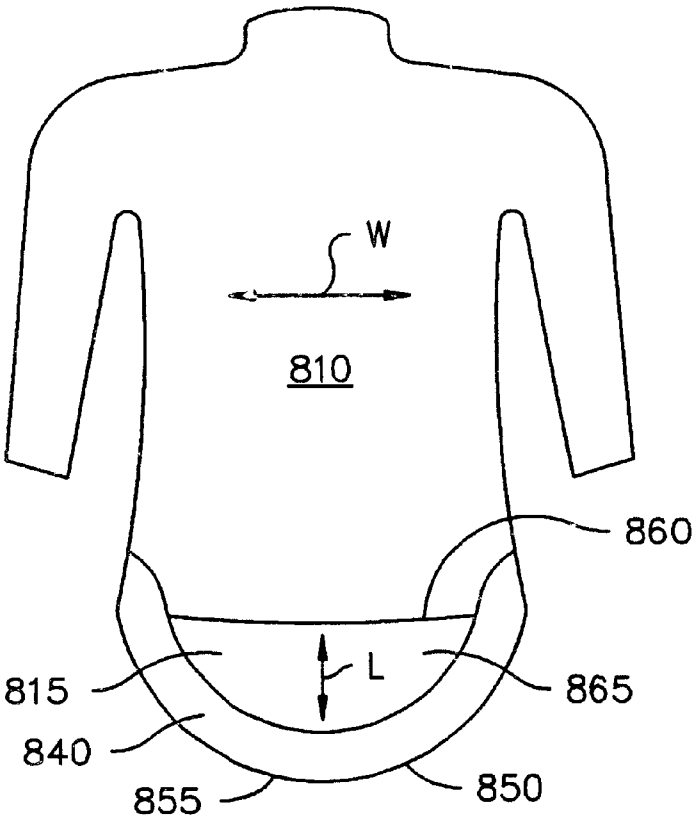
FIG. 8B is a rear elevation view of the shirt shown in FIG. 7A.
Figure 8A:
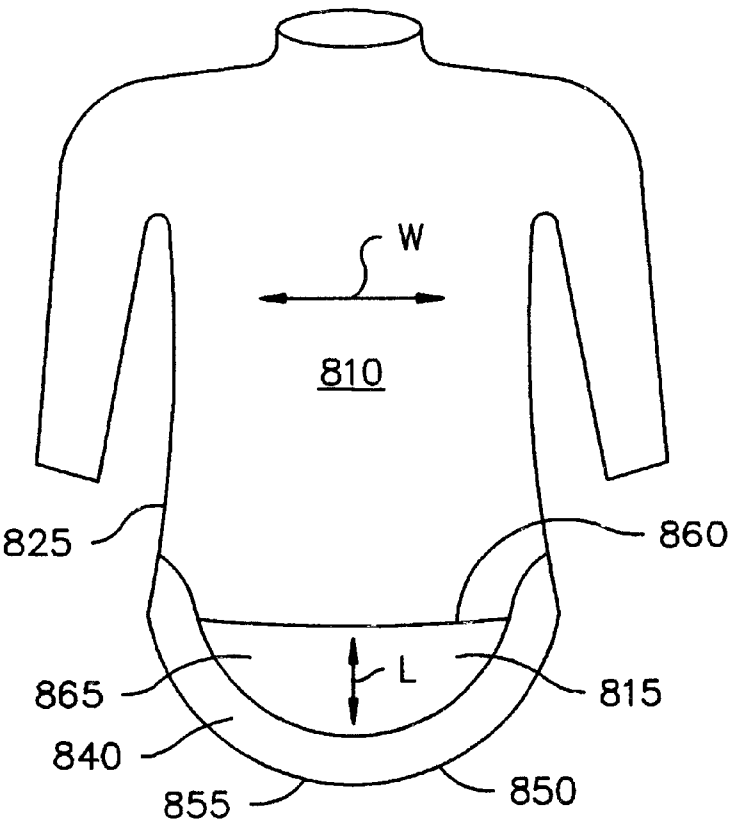
FIG. 8A is a front elevation view of a shirt according to an embodiment of this invention.

Still another preferred embodiment contemplated to be embraced by the present invention is shown in FIGS. 7A and 7B. This embodiment utilized a type I elastic fabric 710 for the shirt body and a type II elastic fabric 740 for the hem. Fabric 710 is oriented so that the elastic direction is aligned widthwise. The hem line 750 descends in both front and rear to form a shirt-tail. Also, the hem includes triangular gussets 755, 775, on the sides of the shirt body.

A further preferred embodiment of the novel garment is seen in FIGS. 8A and 8B to again include a shirt body 825 of mono-directionally elastic type I fabric 810. The fabric is oriented so that the direction of elasticity aligns widthwise as emphasized by arrows W. The shirt also has a hem 855 of bi-directionally elastic type II fabric 840. The hem has a uniform height and extends continuously around front and back of the garment along the complete circumference of the hem line 850. The bi-directionally elastic material adapts the hem to readily stretch over and grip the coaming of a kayak cockpit as mentioned above. This embodiment also includes front and back shirt-tail portions 865 that descend from the waist-line 860. These tails are formed from mono-directionally elastic type I fabric 815, however, the fabric is oriented so that the elastic direction is aligned lengthwise as indicated by the arrows "L". The lengthwise elastic tails improve the ability of the shirt to stretch in the lengthwise direction. This permits the garment to reach the coaming of very elongated kayak cockpits. Because the fabric is highly elastic, the tails may be quite small in the relaxed state. That is, in the relaxed state the dimension of the tail in the lengthwise direction may be short. This feature enhances the appearance of the shirt when not deployed as a spray skirt and renders the shirt desirable for wearing in general purpose activities as well as while kayaking.

Figure 9B:
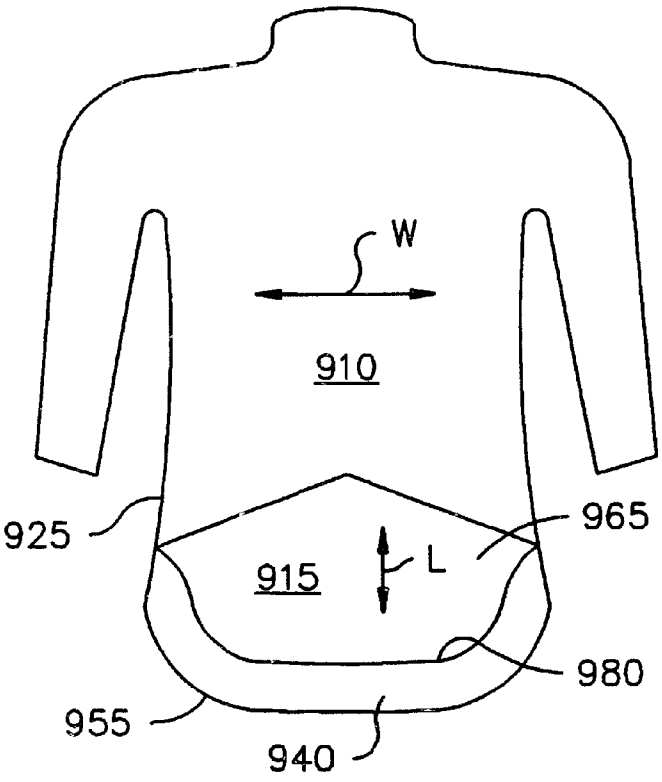
FIG. 9B is a rear elevation view of the shirt shown in FIG. 9A.
Figure 9A:
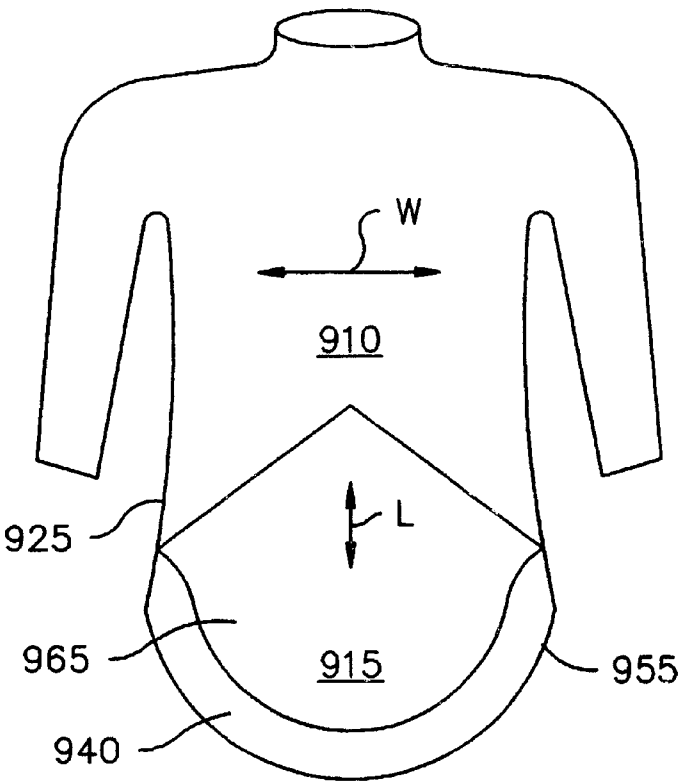
FIG. 9A is a front elevation view of a shirt according to an embodiment of this invention.

A particularly preferred embodiment is illustrated in FIGS. 9A and 9B, in which the front and back, lengthwise oriented type I fabric panels 965 extend upward from the waist line 860 (FIGS. 8A, 8B) into the shirt body 925. Although the drawings are not to scale, they intend to show that the front tail panel 965 (FIG. 9A) is longer, extends farther upward (i.e., lengthwise) into the shirt body 925 and is larger than is the back tail panel 965 (FIG. 9B). Optionally, the lengthwise type I panel 965 can be a uniform height (i.e., dimension in the lengthwise direction) and can extend along the upper edge 980 of the hem 955 completely around the circumference of the garment in beltwise fashion.

In still another embodiment, the shirt body, hem and all panels consist essentially of the same, bi-directionally elastic type II fabric.

It is contemplated that the specific dimensions of the shirt body, hem, gussets and shirt-tail panels can be varied considerably to accomplish the objective of the novel multipurpose garment. Preferably the height of the hem should be about 0.5–4 inches (1.2–10 cm). This range is selected primarily for suitability in stretching the hem over the typical coaming of a kayak cockpit and for durability at a position on the garment subject to increased wear.

Although specific forms of the invention have been selected for illustration in the drawings and the preceding description is drawn in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A multipurpose garment suitable to be worn by a person in a cockpit of a transportation vessel having a coaming surrounding the person, the multipurpose garment comprising (a) a shirt body adapted to cover at least the torso of the person, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, which garment is adapted to stretch elastically such that the hem circumferentially overlaps the coaming to form a complete removable cover over the cockpit between the trunk of the person and the coaming.

2. The multipurpose garment of claim 1 in which the shirt body consists essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension.

3. The multipurpose garment of claim 2 in which the mono-directionally elastic fabric has a weight of less than about 205 g/m$^2$ and comprises a spunbonded fibrous nonwoven sheet of substantially nonbonded, flash spun polyethylene plexifilaments stitchbonded under tension by a two-needle stitched structure of 14 needles per inch, 14 courses per inch pattern of 0-1, 1-0 of chain stitches using a thread of 70 denier spandex elastic yarn wrapped with 40 denier 13 filament nylon yarn and 14 needles per inch, 14 courses per inch pattern of 1-2, 1-0 tricot stitches using a thread of 70 denier 34 filament textured nylon yarn.

4. The multipurpose garment of claim 3 in which the bi-directionally elastic fabric has a weight of less than about 610 g/m$^2$ and comprises one spunbonded fibrous nonwoven sheet of substantially nonbonded, flash spun polyethylene plexifilaments and one powder bonded fibrous nonwoven sheet of staple polyester stitchbonded together by a two-needle stitched structure of 14 needles per inch, 7 courses per inch pattern of a 1-0, 4-5 notation using a thread of an elastic yarn of 70 denier spandex wrapped with 40 denier 13 filament nylon yarn and a 14 needles per inch 7 courses per inch pattern of a 2-3, 1-0 notation using a thread of 70 denier 34 filament textured polyester yarn.

5. The multipurpose garment of claim 1 further comprising fastening means for removably attaching the hem perimeter coextensively to the coaming to form a spray-proof seal between the hem and the coaming.

6. The multipurpose garment of claim 1 in which the panel is coextensive with the complete hem.

7. The multipurpose garment of claim 6 in which the panel extends upward to a uniform height above the hem line.

8. The multipurpose garment of claim 1 which comprises a plurality of panels.

9. The multipurpose garment of claim 8 in which the panels extend upward to a uniform height above the hem line.

10. The multipurpose garment of claim 8 in which the garment includes a pair of triangular panels positioned laterally opposite each other and in which each panel has a side coincident with the hem line of the garment.

11. The multipurpose garment of claim 1 in which the panel extends upward above a horizontal reference line at the waist of the shirt body.

12. The multipurpose garment of claim 11 in which the panel extends upward to a nonuniform height above the horizontal reference line.

13. The multipurpose garment of claim 1 which further comprises a first shirt-tail extending downward a nonuniform distance from a horizontal reference line at the waist of the shirt body.

14. The multipurpose garment of claim 13 in which the first shirt-tail extends downward on the front of the garment which further comprises a second shirt-tail extending downward on the back of the garment.

15. The multipurpose garment of claim 13 in which the panel extends upward to a uniform height above the hemline and in which the first shirt-tail above the panel consists essentially of a mono-directionally elastic fabric characterized by elasticity of at least about 30% in a longitudinal dimension aligned parallel to the length of the garment, and by elasticity of at most about 5% in a transverse dimension orthogonal to the longitudinal dimension.

16. The multipurpose garment of claim 15 in which the first shirt-tail extends upward to a nonuniform height above a horizontal reference line at the waist of the shirt body.

17. An environmental barrier system for a boat comprising, a boat comprising a cockpit to be occupied by the person surrounded by a coaming, a multipurpose garment comprising (a) a shirt body adapted to cover at least the torso of the person, and consisting essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, which garment is adapted to stretch elastically such that the hem circumferentially overlaps the coaming to form a complete removable cover over the cockpit between the trunk of the person and the coaming and fastening means for removably attaching the hem coextensively to the coaming to form a spray-proof seal between the hem and the coaming.

18. The environmental barrier system of claim 17 in which the mono-directionally elastic fabric has a weight of less than about 205 g/m$^2$ and comprises a spunbonded fibrous nonwoven sheet of substantially nonbonded, flash spun polyethylene plexifilaments stitchbonded under tension by a two-needle stitched structure of 14 needles per inch, 14 courses per inch pattern of 0-1, 1-0 of chain stitches using a thread of 70 denier spandex elastic yarn wrapped with 40 denier 13 filament nylon yarn and 14 needles per inch, 14 courses per inch pattern of 1-2, 1-0 tricot stitches using a thread of 70 denier 34 filament textured nylon yarn.

19. The environmental barrier system of claim 18 in which the bi-directionally elastic fabric has a weight of less than about 610 g/m$^2$ and comprises one spunbonded fibrous nonwoven sheet of substantially nonbonded, flash spun polyethylene plexifilaments and one powder bonded fibrous nonwoven sheet of staple polyester stitchbonded together by a two-needle stitched structure of 14 needles per inch, 7 courses per inch pattern of a 1-0, 4-5 notation using a thread of an elastic yarn of 70 denier spandex wrapped with 40 denier 13 filament nylon yarn and a 14 needles per inch 7 courses per inch pattern of a 2-3, 1-0 notation using a thread of 70 denier 34 filament textured polyester yarn.

20. A method of protecting a person from spray in a cockpit of a boat having a coaming surrounding the cockpit comprising the steps of (I) providing a multipurpose garment comprising (a) a spray resistant shirt body adapted to cover at least the torso of the person, and consisting essentially of a mono-directionally elastic fabric characterized by elasticity of at least about 30% in a longitudinal dimension aligned parallel to the width of the garment, and by elasticity of at most about 5% in a transverse dimension orthogonal to the longitudinal dimension, (b) a hem defining a circumferential opening at the bottom of the garment, and (c) a panel proximate to the hem consisting essentially of a bi-directionally elastic fabric characterized by elasticity of at least about 30% in a first dimension and by elasticity of at least about 30% in a second dimension orthogonal to the first dimension, (II) placing the spray resistant shirt on the person, and (III) with the person occupying the cockpit, stretching the hem coextensively over the coaming so that the garment covers the cockpit, thereby shielding the person and the cockpit between the person and the coaming from spray.

21. A combined dry top and spray skirt to be worn by a paddler in a cockpit of a kayak having a coaming surrounding the paddler, the combined dry top and spray skirt comprising a shirt body adapted to cover at least the torso of the person, a hem defining a circumferential opening at the bottom of the garment, and a panel proximate to the hem, all of said shirt body, hem and panel consisting essentially of a bi-directionally elastic fabric characterized by elasticity of at least about 30% in a first dimension and by elasticity of at least about 30% in a second dimension orthogonal to the first dimension, which garment is adapted to stretch elastically such that the hem circumferentially overlaps the coaming to form a complete removable cover over the cockpit between the trunk of the person and the coaming.

* * * * *